United States Patent [19]

Classen et al.

[11] Patent Number: 4,903,473

[45] Date of Patent: Feb. 27, 1990

[54] METHOD FOR CONTROLLING A CAGE STRANDING MACHINE

[75] Inventors: Helmut Classen, Würselen; Rüdiger Lange, Neuss, both of Fed. Rep. of Germany

[73] Assignee: Stolberger Maschinenfabrik GmbH & Co KG, Stolberg, Fed. Rep. of Germany

[21] Appl. No.: 239,583

[22] Filed: Sep. 1, 1988

[51] Int. Cl.[4] ..... D07B 3/06; D07B 7/06

[52] U.S. Cl. ..... 57/15; 57/58.34; 57/93; 57/264

[58] Field of Search ..... 57/3, 10, 58.34, 93, 57/94, 264, 15

[56] References Cited

U.S. PATENT DOCUMENTS

| | | | |
|---|---|---|---|
| 3,393,503 | 7/1968 | Lucas | 57/94 |
| 3,593,508 | 7/1971 | Jackimowicz et al. | 57/3 X |
| 4,294,064 | 10/1981 | Schmitz et al. | 57/3 |
| 4,392,342 | 7/1983 | Meijer | 57/93 X |
| 4,642,979 | 2/1987 | Tomioka et al. | 57/264 |
| 4,716,807 | 1/1988 | Fischer | 87/33 X |

*Primary Examiner*—Joseph J. Hail, III

*Attorney, Agent, or Firm*—Spencer & Frank

[57] ABSTRACT

A stranding machine, and a method for controlling same wherein a measurement device is utilized to measure the centrifugal forces of a spool of the stranding machine. The strand spool rotation rate is then regulated dependent upon the measured centrifugal forces. As the material is depleted from the spool, the spool rotation rate is increased while maintaining a centrifugal force reading within given perimeters.

16 Claims, 3 Drawing Sheets

METHOD FOR CONTROLLING A CAGE STRANDING MACHINE

BACKGROUND OF THE INVENTION

The invention relates to a method of controlling a cage stranding machine comprising at least one stranding cage which holds a plurality of spools for the material being stranded, a removal for the stranded material and a coiling device.

The production output of stranding machines, with a given lay length of the stranded material, is a direct function of the number of revolutions of the stranding cage therefore such machines are designed for the highest possible numbers of revolution to provide maximum production output. In the past, it was customary to run the machines up to a constant operating speed for the respective quantity of stranded material to be produced and to then maintain that speed practically to the end. For example, stranding cages rated at speeds of 320 revolutions per minute were provided to strand aluminum wires. However, such a speed cannot be maintained in practice since, due to unavoidable eccentricities resulting from irregular winding of the spools in the stranding cage. In practice it is possible to operate only at a lower speed in spite of the fact that the machine is designed for the desired number of revolutions per minute. While it is certainly possible structurally, to design such a stranding machine, to operate at the given desired number of revolutions, problems will still result from the eccentricities resulting from the irregularly wound spools while they rotate about their own axes. The individual spools rotating at the same time produce different tensile stresses on the wire supplied from the spool to the stranding locations and these stresses may ultimately be s high at the given rated speeds that the respective wire is stretched until it breaks. In the case of a break in the wire, the machine must be stopped, the two wire ends must be welded together and then the machine can be started up again. To prevent this in the given example, the machine is actually operated, in spite of the given rated number of revolutions, at a lower speed of, for example 250 rpm, so that in the end the intended production output of the machine is not realized.

BRIEF SUMMARY OF THE INVENTION

It is the object of the invention to provide an improved stranding machine and a method for controlling the stranding machine, which permits high production output with gentle treatment of the material being stranded.

This is accomplished according to the invention in that the centrifugal force acting on the spool body is measured at at least one spool and the rate of revolution of the stranding cage and the removal rate of the stranded material are regulated based on the measured value of the centrifugal force. The ratio of cage revolutions to removal rate is maintained constant in correspondence with the given length of a lay of the stranded material to be produced. With the aid of this method, it is possible to operate at a lower speed at the beginning of the stranding job, when the spools lying in the stranding cage are still completely filled, but to then, with decrease of the coil diameter, to increase the number of cage revolutions. The centrifugal force acting on the spool bodies provides a measure for the decrease of the coil diameter and represents a guide variable according to which the number of cage revolutions and the removal speed are regulated. In this connection, it is sufficient to measure the centrifugal force of only one spool since, in principle, all spool are wound as uniformly as possible. However, it is advisable for the spool having the greatest starting weight to be placed into the stranding basket equipped with the spool carrier provided with a measuring location. With the aid of this method, it is possible to always operate the stranding machine in an optimum speed range. The stranding machine is initially run up to a starting number of revolutions per minute which is determined by the given centrifugal force. Then there results a progressive rise over the remaining period of operation up to the maximum permissible number of revolutions which can be maintained until the end of the stranding job so that, as a whole, a considerable increase in production results with improved quality, and breaks in the wire are practically avoided. A further advantage of the method according to the invention is that the measurement of the centrifugal force can be made without moving parts, for example by installing a so-called electrical pressure pickup in the spool bearing of one of the spool carriers. The transfer of the measurement signal may then occur either by way of a slip ring or without contact by way of a transmitter. Depending on the type of drive employed to drive the stranding machine, the removal device and the winding device, the measuring as well as the change in the number of cage revolutions per minutes and the removal rate may here take place continuously or also at given time intervals. A further advantage of the method according to the invention is that the machine does not require any additional selector circuit it which it would have to be set for different materials to be stranded. Thus, it is possible without any switching measures to initially charge the stranding machine with a stranding material having a higher specific weight, for example copper, and then with a stranding material having a lower specific weight, for example aluminum. This is insignificant for the regulation process since the given centrifugal force as the guide variable also automatically results in the respectively permissible number of cage revolutions per minute.

Measurement of centrifugal force automatically takes into account the weight of the material on the spool since the greater the weight, the greater the centrifugal force generated by the spinning spool. Another advantage of the method according to the invention is that, on the basis of the constant centrifugal force stress, the machines as a whole, including the spools and the spool bearings, are much less subjected to stresses so that there is much less wear to be noted. Since, moreover, the machines operate at a lower number of revolutions at the beginning of the stranding job, correspondingly smaller drive motors can be employed. Accordingly, the brakes for the stranding cage may also be given smaller dimensions.

An advantageous feature of the invention further provides that if the centrifugal force measuring signal is pulsating, only the respectively measured maximum value is switched to the speed control device as the cage revolution and removal rate control regulating signal. In this way, it is ensured that even if the spool being measured is wound in an unfavorable manner, the regulation permit a change only in the form of an increase in the number of revolutions.

Another advantageous feature of the invention provides that the centrifugal forces of a plurality of spools can be measured, the resulting measurement signals are fed to a comparator and the greatest centrifugal force measured is switched to the speed control device as the control signal to change the number of cage revolutions and the removal rate. Although this procedure requires higher construction expenditures, it has the advantage that, particularly in connection with large cage stranding machines operating with a plurality of spools, irregular coiling in one or several spools is already considered in the measuring result and thus it is possible to ensure, in particular, unchanging quality of the stranded material.

A further advantageous feature of the method according to the invention provides that the actual length of the lay of the resulting stranded material is continuously measured downstream of the cage stranding machine and is compared with the given lay length. The drive for the stranding machine or the removal device is regulated as a function of the resulting difference value. This permits an even more sensitive regulation and an improvement of product quality.

BRIEF DESCRIPTION OF THE DRAWINGS

The invention will now be described in greater detail with reference to schematic drawings of one embodiment. It is shown in.

DETAILED DESCRIPTION OF EXEMPLARY EMBODIMENTS

Figure 1:
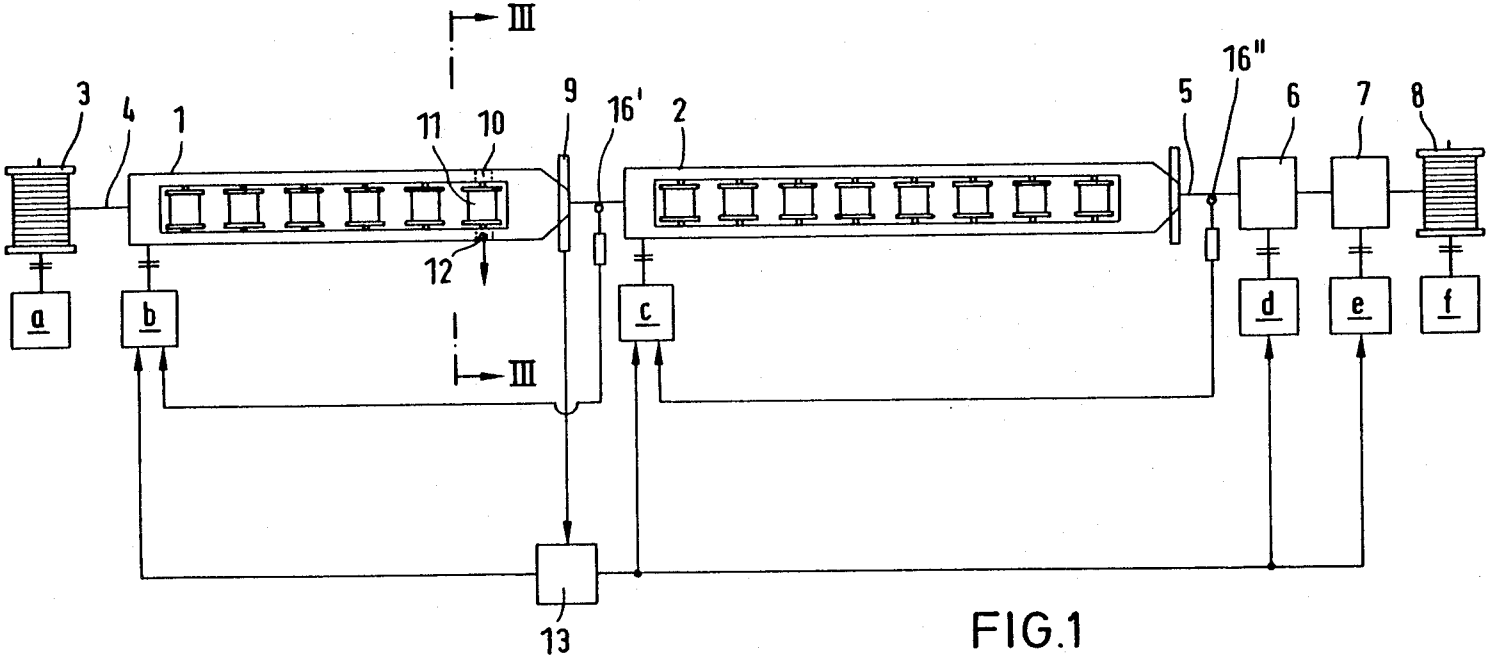
FIG. 1, a cage stranding machine in the form of a block circuit diagram.

The stranding system shown schematically in FIG. 1 is essentially composed of a cage stranding machine including two stranding cages 1 and 2. Stranding cage 1 is here provided with a total of twelve spools, while stranding cage 2 is provided with a total of sixteen spools. An unwinding mechanism 3 is connected upstream of the cage stranding machines to unwind a so-called core strand 4 and guide it through the two stranding cages to thus serve as a basis for the stranded layers. In the illustrated embodiment, the stranded material 5 removed from stranding cage 2 is also guided through a device 6 in which a sheath is spun around the stranded material 5. The finish stranded and sheathed material is then removed by way of a double-disc removal device 7 and is wound on drums in a coiler 8.

In the illustrated embodiment, stranding cage 1 is operated at such a number of cage revolutions that, with the given throughput rate, i.e. the removal speed given by removal device 7, a lay length of 250 mm is realized. To realize a perfect, two-layer structure, stranding cage 2 is operated at a somewhat lower number of cage revolutions so that here a lay length of 300 mm results for the second layer. Due to the shorter lay length, stranding cage 1 is operated at a higher number of revolutions so that the speed regulation of this machine determines the production output of the entire system.

Both stranding cages 1 and 2 and spinning device 6 as well as removal device 7 may now be driven either by one drive motor equipped with a mechanical transmission for all machines or, as shown in FIG. 1, by way of individual electrical drive motors at each machine which, however, are positively driven by electronic means at a predetermined, given rpm ratio relative to one another.

Corresponding to the proposed regulating procedure, the system is now designed in such a manner that spool carrier 10 in stranding cage 1 lying closest to stranding rack 9 is provided with a measurement value pickup 12 at the bearing for spool 11 by way of which the centrifugal forces exerted by spool 11 on spool carrier 10 can be measured. The measurement signal is switched to an electronic evaluation system 13, either by way of a transmitter or by way of a slip ring. This electronic evaluation system is in turn connected with the speed regulating devices for the individual drive motors b, c, d and e. Electronic evaluation system 13 is here set to a fixed desired centrifugal force value so that the number of revolutions of the individual drive motors can be varied in a given mutual relationship according to the deviation between the actual centrifugal force value measured by measurement value pickup 12 and the given desired value. Since the spool weight decreases with increasing duration of the stranding job, the speed of all drives must be increased according to the given desired value. Since now the length of the lay for the stranded material is to remain practically constant over its entire length, the speed of advancement of the finish stranded material must accordingly also be increased by appropriately increasing the number of revolutions of drive motor e for removal device 7. Drive f for coiler 8 is regulated in the conventional manner, independently of the drives for the cage stranding machine, as a function of the tension in the stranded material. In contrast thereto, unwinding mechanism 3 is provided only with a brake a for regulating the tension.

Since the second layer applied by way of stranding cage 2 should also be applied with a constant lay length, the number of revolutions of motor c which drives stranding cage 2 must also be increased correspondingly as a function of the given lay length and the removal rate now given by the number of revolutions of motor e of removal device 7. The same applies also for drive d of sheathing device 6.

Figure 2:
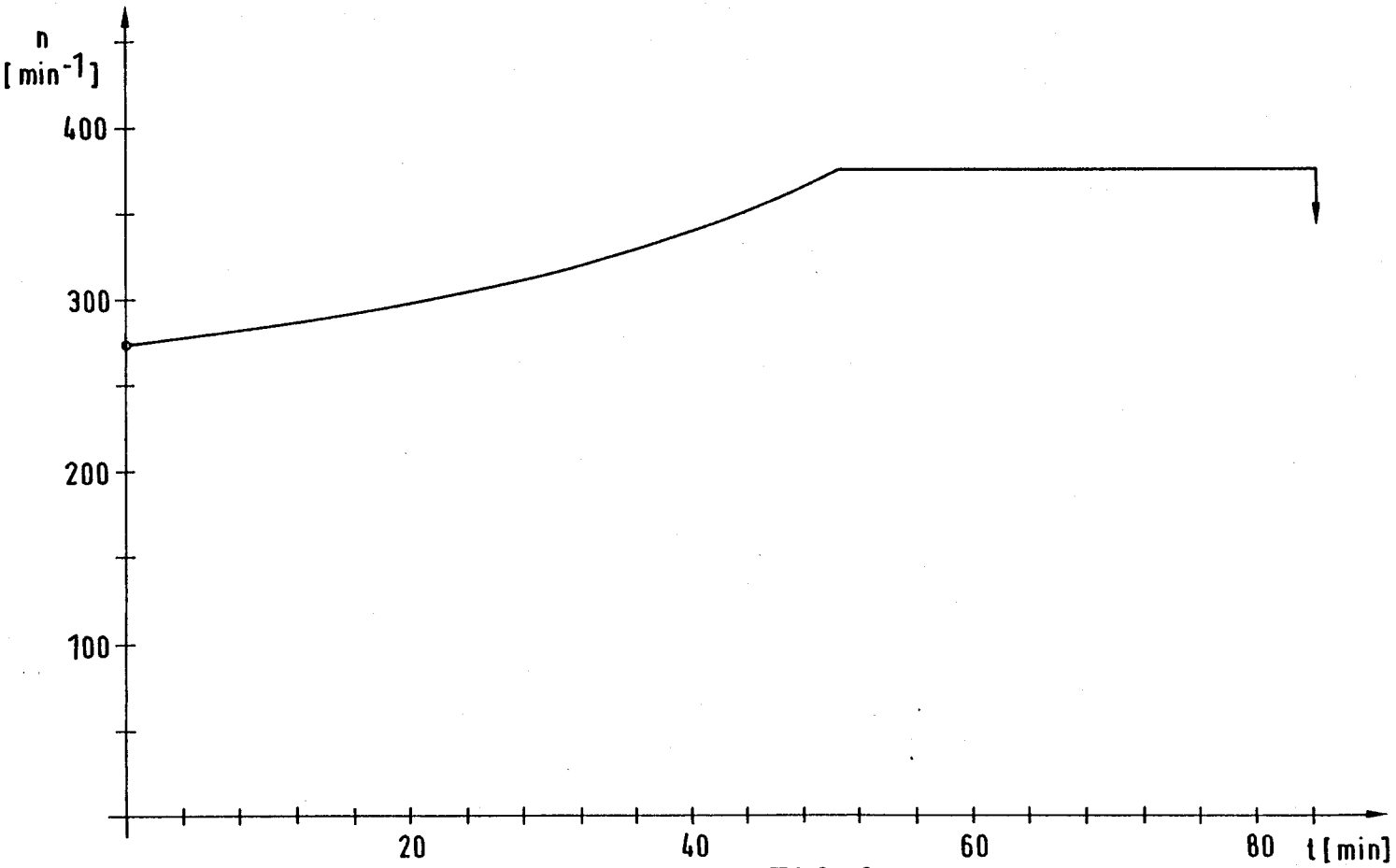
FIG. 2, a diagram of the number of cage revolutions over time.

For example, insulated individual copper conductors having a cross section of 1.5 $mm^2$ are to be stranded with the illustrated cage stranding system. This results in a gross spool weight of 186 kg. With the given lay length of 250 mm, a desired centrifugal force value of 60,000N is given for stranding cage 1. As shown in FIG. 2, this permits a starting speed of 272 rpm and a removal rate at the beginning of the stranding job of about 68 m per minute for the given lay length of 250 mm. Corresponding to the continuous decrease of material to be stranded on the spool and the resulting reduction in spool mass, the number of cage revolutions can now be increased continuously, as indicated schematically in FIG. 2, so that the maximum number of revolutions of about 380 rpm permitted for the machine is reached after about 50 minutes. This maximum number of revolutions is then used to remove the remainder of the material to be stranded from the spools so that stranding cage 1 can be operated at the maximum number of revolutions for about 15 minutes of the total operating period of about 80 minutes. As a whole, there thus results an average removal rate for the finish stranded material of about 82 m/min. For stranding cage 2, a lower number of cage revolutions results which corresponds to the greater length of the lay.

While, with the described regulation, stranding cage 1 is subjected to a centrifugal force of 60,000N, it would have to absorb a maximum centrifugal force stress of 88,000 N for the same production output without the proposed regulation, i.e. with operation at a constant number of cage revolutions This comparison of numbers itself already indicates that it is possible with the proposed regulating method to considerably reduce the required start-up power, construction costs for all bearings and for the cage brakes.

Figure 3:
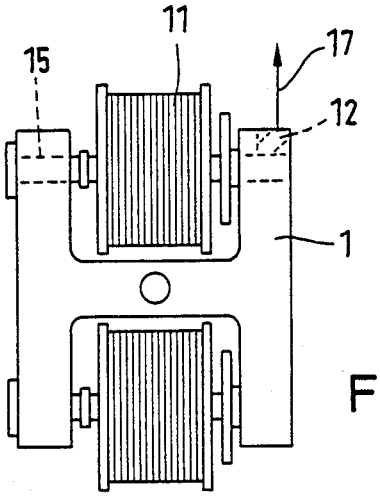
FIG. 3, a cross-sectional view to a larger scale of a stranding cage.

As shown by the cross-sectional view of FIG. 3, two parallel rows of spools 11 are exchangeably arranged in each stranding cage, one behind the other in the axial direction. For this purpose, the spindle sleeves 15 for the spools are opened in a known manner for the respective upper row and, after the empty spools are taken out, the full spools 11 are inserted by way of a loading device and the spindle sleeves are closed. Once the stranding cage has been rotated about 180° by means of an auxiliary drive, the same loading operation takes place for the second row of spools.

In the region of the spool bearing, the stranding cage is provided with a measurement value pickup 12 for at least one spool. Measurement value pickup 12 may be, for example, a so-called pressure pickup on which a spool bearing is outwardly supported in the radial direction. Such pressure pickups are composed, for example, of a metal body onto which strain gauges are glued in the customary manner. Upon deformation of the body, the electrical resistance of the strain gauge changes in proportion with the deformation and thus in proportion with the deforming force. Instead of strain gauges, piezo-electric systems or other force-measuring systems may also be employed. The direction of the centrifugal force to be measured is indicated by arrow 17 which is oriented perpendicularly to the spool axis.

As shown in FIG. 1, a mechanically or optically acting pickup 16' and 16'' may be arranged as an additional measure downstream of one stranding cage to monitor the length of the lay. If there is a deviation of the length of the lay from the given value, an additional regulating action connected in cascade with the regulation on the basis of the centrifugal force can be used for a machine operating with a single layer to regulate the number of revolutions of the drive for removal device 7.

However, in the embodiment of FIG. 1 which involves a machine operating with two layers, this regulating action must be superposed on the regulation of the number of cage revolutions as a function of the centrifugal force since each layer must be regulated independently while the removal rate is regulated by way of the drive for the removal device exclusively as a function of the centrifugal force. Since this superposed regulating action to produce a constant lay length simultaneously influences the centrifugal force measurement, this additional measurement signal must be subtracted with the correct sign from the centrifugal force measurement signal in electronic evaluation system 13, i.e. if the number of cage revolutions is increased slightly in order to regulate the length of the lay, a corresponding, proportional amount must be subtracted from the measured value of the centrifugal force signal so that only a corrected measurement signal acts on the drive of the removal device.

We claim:

1. Method of controlling a cage stranding machine for producing stranded material, having at least one rotatable stranding cage having a plurality of supporting means for holding a plurality of spools for the material being stranded and a removal device for the stranded material as well as a winding device, comprising the steps of:

measuring the centrifugal force acting on the spool body of at least one spool with a measuring means including a force sensing pickup operatively associated with at least one of said supporting means and directly coupled to said at least one spool, and regulating the rotation rate of the stranding cage and the removal rate of the stranded material in dependence on the measured force value and a given constant value for the centrifugal force, with the ratio of cage revolutions to removal rate being kept constant in correspondence with the given length of lay of the stranded material to be produced.

2. Method according to claim 1, wherein the steps of measuring the centrifugal force and regulating the rotation rate and the removal rate are effected continuously.

3. Method according to claim 1, wherein the steps of measuring the centrifugal force and regulating the rotation rate and the removal rate are effected at time intervals.

4. Method according to claim 1, characterized in that the centrifugal force is measured at the pool having the greatest starting weight.

5. Method according to claim 1 wherein, if the measured centrifugal force is pulsating, only the maximum measured value is utilized to regulate the rotation rate and the removal rate.

6. Method according to claim 1, wherein the step of measuring includes measuring the centrifugal forces of a plurality of spools and comparing the measurement values from each of the spools to determine the greatest value, and wherein the step of regulating includes utilizing the greatest measured centrifugal force value to regulate the rotation rate and the removal rate.

7. Method according to claim 1, comprising the further steps of monitoring the actual length of the lay of the resulting stranded material downstream of the cage stranding machine, comparing the given length of the lay with the actual length, and adjusting the ratio of cage revolutions to removal rate dependent on the comparison result.

8. In a stranding machine having at least one rotatable stranding cage configured for accepting a strand core and including a plurality of means for supporting a plurality of material holding spools, wherein said material is wrapped about said strand core to form finish stranded material, and means for removing the stranded material from said cage, the improvement comprising:

means for measuring the centrifugal force acting on at least one of said material spools, and for producing a signal indicative of said measured value, said measuring means including a force sensing pickup operatively associated with at least one of said supporting means and directly coupled to said at least one of said spools, and controlling means for receiving said signal and for controlling the rotation rate of said stranding cage and the removal rate of the stranded material dependent on the measured value of the centrifugal force.

9. A stranding machine according to claim 8, wherein said controlling means further includes means for maintaining a target ratio between said cage rotation rate and said removal rate.

10. A stranding machine according to claim 9, wherein said ratio is dependent upon the desired lay length for the finish stranded material.

11. The stranding machine according to claim 9, further comprising:

monitoring means for detecting the resultant lay length after removal of the finish stranded material, compensation means operatively connected to said monitoring means, for adjusting said target ratio dependent upon said resultant lay length.

12. A stranding machine according to claim 8, wherein;

said measuring means and said controlling means act continuously to regulate the stranding operations.

13. A stranding machine according to claim 8, wherein;

said measuring means and said controlling means operate at predetermined time intervals.

14. A stranding machine according to claim 8, wherein;

said measuring means is operatively connected to the supporting means associated with the material spool of greatest weight.

15. A stranding machine according to claim 8, wherein;

said signal is indicative of the maximum measured centrifugal force.

16. In a stranding machine having at least one rotatable stranding cage configured for accepting a strand core and including a plurality of means for supporting a plurality of material holding spools, wherein said material is wrapped about said strand core to form finish stranded material, and having drive means for rotating said stranding cage and means for removing the stranded material from said cage, the improvement comprising:

means for independently measuring the centrifugal force acting on each of a plurality of said material spools, including a number of force sensing pick-ups, each operatively associated with a respective one of said supporting means and directly coupled to a respective one of said spools, coordinating means connected to said measuring means for producing a control signal indicative of the greatest measured centrifugal force, and controlling means connected to said driving means for receiving said control signal and for controlling the rotation rate of said stranding cage and the removal rate of the stranded material dependent on the measured value of the centrifugal force.

* * * * *